US010223992B2

(12) United States Patent
Du

(10) Patent No.: US 10,223,992 B2
(45) Date of Patent: Mar. 5, 2019

(54) CASCADED GATE-DRIVER ON ARRAY DRIVING CIRCUIT AND DISPLAY PANEL

(71) Applicant: SHENZHEN CHINA STAR OPTOELECTRONICS TECHNOLOGY CO., LTD., Shenzhen (CN)

(72) Inventor: Peng Du, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 100 days.

(21) Appl. No.: 15/327,564

(22) PCT Filed: Jan. 6, 2017

(86) PCT No.: PCT/CN2017/070466
§ 371 (c)(1),
(2) Date: Jan. 19, 2017

(87) PCT Pub. No.: WO2018/120286
PCT Pub. Date: Jul. 5, 2018

(65) Prior Publication Data

US 2018/0218699 A1 Aug. 2, 2018

(30) Foreign Application Priority Data

Dec. 27, 2016 (CN) ..... 2016 1 1227442

(51) Int. Cl.
*G09G 3/36* (2006.01)

(52) U.S. Cl.
CPC ..... *G09G 3/3677* (2013.01); *G09G 3/3659* (2013.01); *G09G 2300/0404* (2013.01);
(Continued)

(58) Field of Classification Search
CPC .. G09G 3/3677; G09G 3/3648; G09G 3/3674; G09G 3/3688; G09G 3/3266;
(Continued)

(56) References Cited

U.S. PATENT DOCUMENTS 7,839,374 B2 * 11/2010 Kim ..... G09G 3/3677 345/100
9,953,605 B2 * 4/2018 Nishiyama ..... G09G 3/3677
(Continued)

FOREIGN PATENT DOCUMENTS

CN 103631023 A 3/2014
CN 103730093 A 4/2014
CN 105372892 A 3/2016

*Primary Examiner* — Darlene M Ritchie
(74) *Attorney, Agent, or Firm* — Kirton McConkie; Evan R. Witt

(57) ABSTRACT

The present disclosure proposes a driving circuit. The driving circuit includes gate-driver on array (GOA) unit sets at n stages, an nth stage GOA unit set corresponding to an nth row of primary scanning line and an (n−k)th row of secondary scanning line. The GOA unit set includes two GOA units arranged at the corresponding sides of the scanning line set. The nth stage GOA unit arranged at a first side where the scanning line set is arranged is connected to the nth stage GOA unit arranged at a second side where the scanning line set is arranged.

3 Claims, 6 Drawing Sheets

(52) U.S. Cl.
CPC ..... *G09G 2300/0408* (2013.01); *G09G 2310/0251* (2013.01); *G09G 2310/0283* (2013.01); *G09G 2310/0286* (2013.01)

(58) Field of Classification Search
CPC ..... G09G 2310/0286; G09G 2310/08; G09G 2310/0283; G09G 2310/0264; G09G 2310/0243; G09G 2310/0251; G09G 2300/0408; G09G 2300/0404; G02F 1/13454
See application file for complete search history.

(56) References Cited

U.S. PATENT DOCUMENTS

2006/0007085 A1* 1/2006 Kim ..... G09G 3/3677 345/87
2007/0132700 A1 6/2007 Cho
2008/0211760 A1* 9/2008 Baek ..... G09G 3/3677 345/98
2009/0096737 A1* 4/2009 Kim ..... G09G 3/3677 345/98
2011/0002438 A1* 1/2011 Kim ..... G11C 19/28 377/67
2014/0176410 A1* 6/2014 Ma ..... G09G 3/3622 345/92
2015/0221272 A1 8/2015 Xu
2015/0294636 A1* 10/2015 Yu ..... G09G 3/3655 345/204
2016/0049123 A1* 2/2016 Jeong ..... G09G 3/3607 345/690
2016/0189794 A1* 6/2016 Lou ..... G11C 19/28 345/214
2018/0047759 A1* 2/2018 Zhao ..... G09G 3/3674
2018/0095583 A1* 4/2018 Kim ..... G02F 1/13338

* cited by examiner

CASCADED GATE-DRIVER ON ARRAY DRIVING CIRCUIT AND DISPLAY PANEL

BACKGROUND

1. Field of the Disclosure

The present disclosure relates to the field of liquid crystal display (LCD), and more particularly, to a driving circuit and a display panel.

2. Description of the Related Art

A gate-driver on array (GOA) technique is widely applied by the industry because the size of a panel bezel is narrowed down and the production costs are reduced after the application of the GOA technique.

Please refer to FIG. 1 illustrating a diagram of an equivalent circuit. A thin-film transistor (TFT) T11 of an nth stage GOA unit is connected to a ST(n−2) signal. The ST(n−2) signal turns a current stage GOA circuit on; in other words, the voltage level of a Q node is pulled up. An input terminal of the TFT T21 and an input terminal of the TFT T22 are connected to a clock signal CK. The TFT T21 outputs a current stage scanning signal G(n). The TFT T22 outputs a ST(n) signal. The ST(n) signal is used to turn the next stage GOA circuit on. An input terminal of the TFT T31 and an input terminal of the TFT T41 are connected to a low voltage level signal VSS to pull down the voltage level of the Q node and the scanning signal G(n).

A load is imposed on the circuit, so a panel with the GOA structure usually adopts the double driver structure. However, a STV signal in a conventional GOA circuit is transmitted through a single side. Once a STV signal is output by an abnormal GOA unit at a certain stage, the following GOA units and the cascaded GOA units all are ineffective.

Therefore, it is necessary to provide a driving circuit and a display panel to solve the problems related to the related art.

SUMMARY

A driving circuit and a display panel are proposed by the present disclosure to reduce the width of a gate-driver on array (GOA) zone.

According to the present disclosure, a driving circuit configured to input a scanning signal to a display panel is provided. The display panel comprises n rows of pixels. A scanning line set is correspondingly arranged on each of the n rows of pixels. The scanning line set comprising a primary scanning line and a secondary scanning line.

The driving circuit comprises gate-driver on array (GOA) unit sets at n stages, a first clock signal set, and a second clock signal set. The first clock signal set and the second clock signal set are arranged opposite. An nth stage GOA unit set corresponds to an nth row of primary scanning line and an (n−k)th row of secondary scanning line. The GOA unit set comprises two GOA units arranged at the corresponding sides of the scanning line set.

The nth stage GOA unit arranged at the side where the scanning line set is arranged is cascaded with the (n+k)th stage GOA unit at the same side.

An output terminal of the nth stage GOA unit arranged at a first side where the scanning line set is arranged is connected to an (n−k)th row of secondary scanning line. The output terminal of the nth stage GOA unit arranged at a second side where the scanning line set is arranged is also connected to the (n−k)th row of secondary scanning line, where "n" is greater than or equal to one, and "k" is greater than or equal to one.

According to the present disclosure, a driving circuit configured to input a scanning signal to a display panel is provided. The display panel comprises n rows of pixels. A scanning line set is correspondingly arranged on each of the n rows of pixels. The scanning line set comprises a primary scanning line and a secondary scanning line.

The driving circuit comprises gate-driver on array (GOA) unit sets at n stages, an nth stage GOA unit set corresponding to an nth row of primary scanning line and an (n−k)th row of secondary scanning line. The GOA unit set comprises two GOA units arranged at the corresponding sides of the scanning line set.

The nth stage GOA unit arranged at the side where the scanning line set is arranged is cascaded with the (n+k)th stage GOA unit at the same side.

The nth stage GOA unit arranged at a first side where the scanning line set is arranged is connected to the nth stage GOA unit arranged at a second side where the scanning line set is arranged, where "n" is greater than or equal to one, and "k" is greater than or equal to one.

According to the present disclosure, a display panel comprising a plurality of scanning lines sets, a plurality of data lines, and a plurality of pixels defined by the scanning line set and the data line is provided.

The pixel comprises a main pixel zone and a subpixel zone. The main pixel zone comprises a first charging module configured to charge the main pixel zone while charging the subpixel zone, and a pull-up module configured to pull up voltage level of the main pixel zone after the main pixel zone and the subpixel zone are completely charged.

The subpixel zone comprises a second charging module configured to charge the subpixel zone while charging the main pixel zone, and a pull-down module configured to pull down voltage level of the sub pixel zone after the main pixel zone and the subpixel zone are completely charged.

The output terminal of the GOA unit at the same stage at the left side is connected to the GOA unit at the right side in the diver circuit and display panel proposed by the present disclosure. Once a STV signal of the GOA unit at either side is abnormal, a STV signal of the GOA unit at the other side (i.e. the normal side) is transmitted to the GOA unit at the abnormal side to prevent the following GOA units ineffective.

DETAILED DESCRIPTION OF THE PREFERRED EMBODIMENTS

Figure 1:
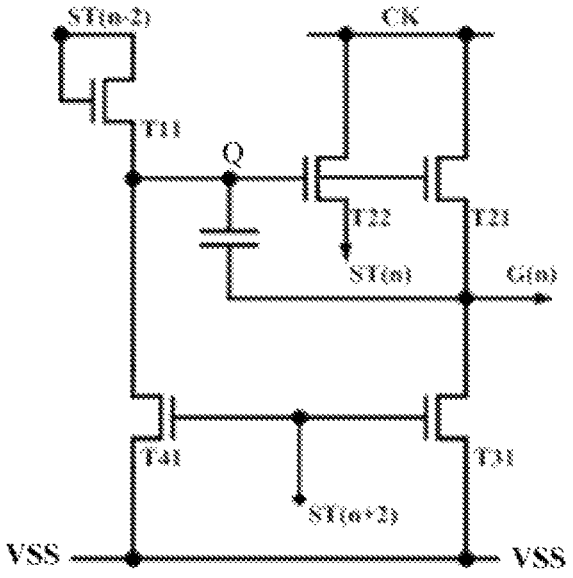
Fig. 1 (Prior art)
FIG. 1 illustrates an equivalent circuit diagram of a conventional GOA unit.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. In the drawings, the components having similar structures are denoted by the same numerals.

Figure 2:
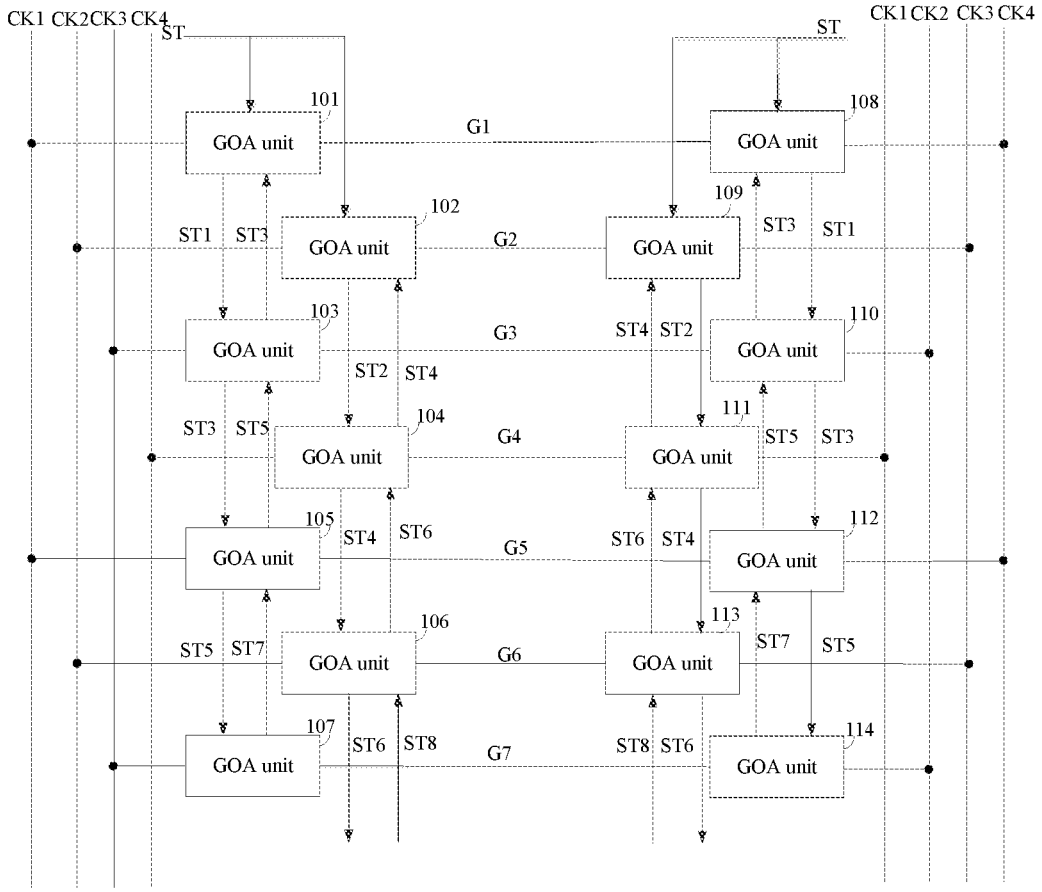
FIG. 2 illustrates a schematic diagram of a driving circuit according a first embodiment of the present disclosure.
Figure 3:
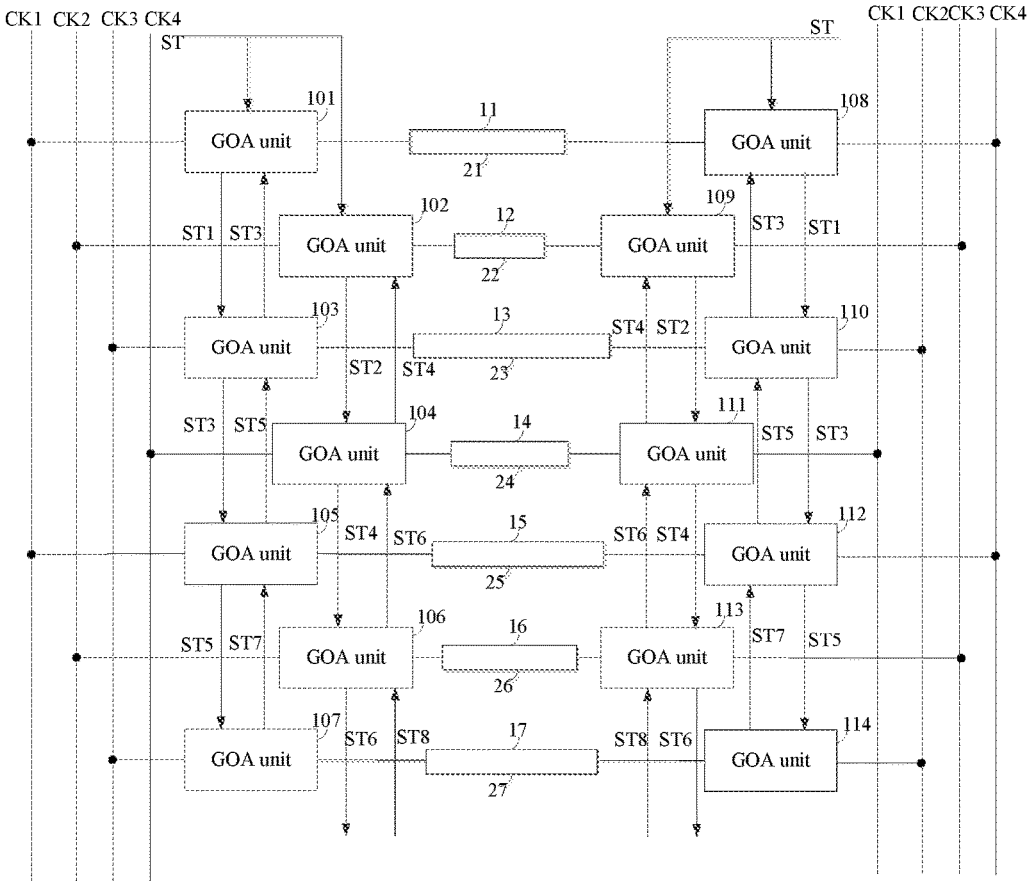
FIG. 3 illustrates a schematic diagram of a driving circuit according a second embodiment of the present disclosure.
Figure 4:
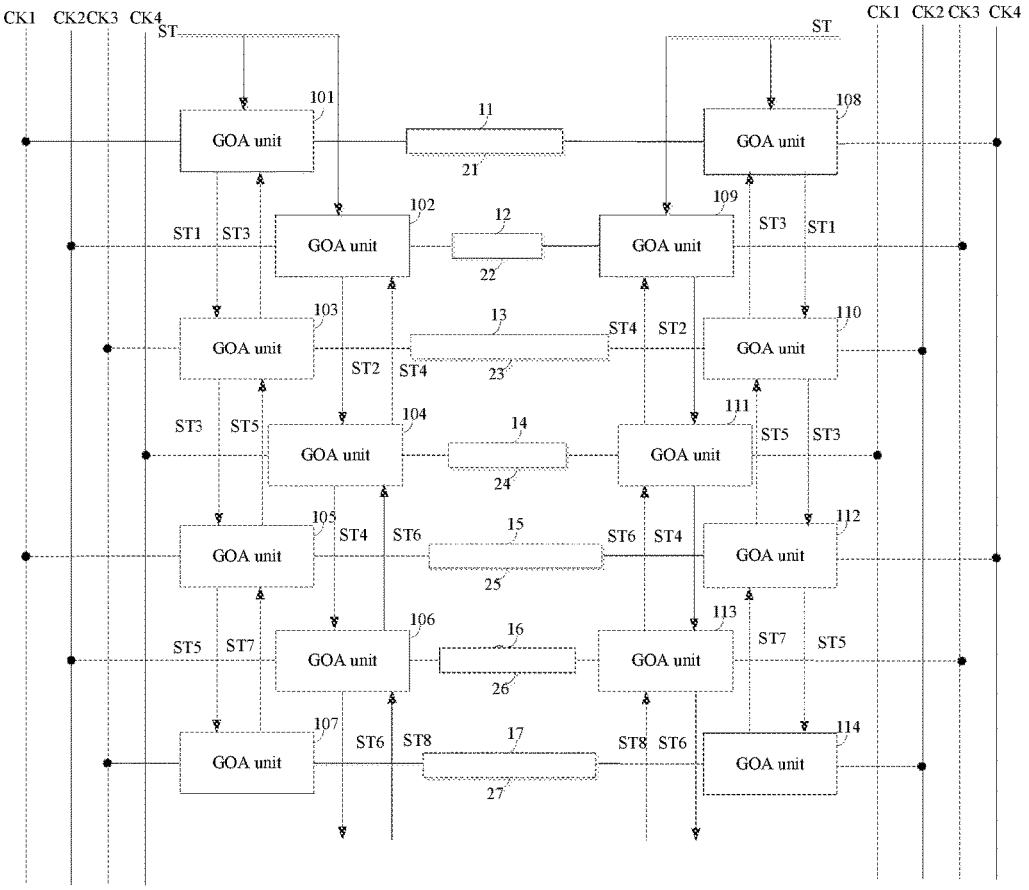
FIG. 4 illustrates a schematic diagram of a driving circuit according a third embodiment of the present disclosure.

Please refer to FIG. 2 to FIG. 4 illustrating schematic diagrams of driving circuits according to the present disclosures.

As FIG. 2 shows, a driving circuit proposed by a first embodiment is a gate-driver on array (GOA) circuit. A seven-stage GOA unit is arranged on each side of the driving circuit; the seven-stage GOA unit is 101-114. In the forward scanning, a cascade signal ST1 is input to a third stage GOA unit 103 from a first stage GOA unit at the left. A cascade signal ST2 is input to a fourth stage GOA unit 104 from a second stage GOA unit at the left. A cascade signal ST3 is input to a fifth stage GOA unit 105 from a third stage GOA unit at the left. A cascade signal ST4 is input to a sixth stage GOA unit 106 from a fourth stage GOA unit at the left. A cascade signal ST5 is input to a seventh stage GOA unit 107 from a fifth stage GOA unit at the left.

Two signals G(n) and ST(n) are output by every stage GOA unit. The signal G(n) is from a signal G(1) to a signal G(7). The signal ST(n) is from a signal ST1 to a signal ST8. The signal G(n) is used to control a corresponding gate line. The signal G(n) is used to turn on an (n+2)th stage GOA unit. Meanwhile, the signal ST(n) is connected to a pull-down control portion of an (n−2)th stage GOA unit. For example, the third stage GOA unit inputs the signal ST3 to the first stage GOA unit 101 to pull the voltage level of the output terminal of the first stage GOA unit 101 down. The similar condition occurs to the remaining GOA units at other stages. The signal ST of the first stage GOA unit 101 and the second stage GOA unit at the left and right sides are directly supplied by the driver integrated circuit (IC).

In FIG. 2, the scanning signal output by the same stage GOA unit at both sides is connected to the same gate line while the output STV signal is unilaterally transmitted. The waveform of the ST(n) signal and the waveform of the G(n) signal output by every stage GOA unit is completely identical, that is, a square wave signal.

In FIG. 3, the scanning signal output by the GOA unit at every stage controls two gate lines, an (n−2)th secondary gate lines 11-17 and an nth primary gate lines 21-27. The nth stage GOA unit corresponds to the nth primary gate line and is used to charge the nth row of pixel. The nth stage GOA unit further corresponds to the (n−2)th secondary gate line and is used to share charge with the (n−2)th row of pixel. Meanwhile, the nth stage GOA unit further outputs a ST(n) signal. Therefore, the voltage level of the Q node of the (n+2)th stage GOA unit is pulled up. The nth stage GOA unit is also connected to the pull-down circuit of the (n−2)th stage GOA unit to pull the Q node of the (n−2)th stage circuit and the G(n−2) signal down to the Vss voltage. As FIG. 2 shows, the ST signal output by a double-sided driven GOA unit is also transmitted through a single side.

Therefore, when the output signal ST signal at the GOA circuit at some stage is ineffective, a chain reaction shows up. As FIG. 4 shows, specifically, when the output signal ST1 signal at the first stage GOA circuit at the right side is ineffective (as if the T22 is abnormal), the third stage GOA, the fifth stage GOA, the seventh stage GOA circuits below fail cannot be turned on. As the dotted line in the figure shows, the circuit fails to work normally accordingly.

Figure 5:
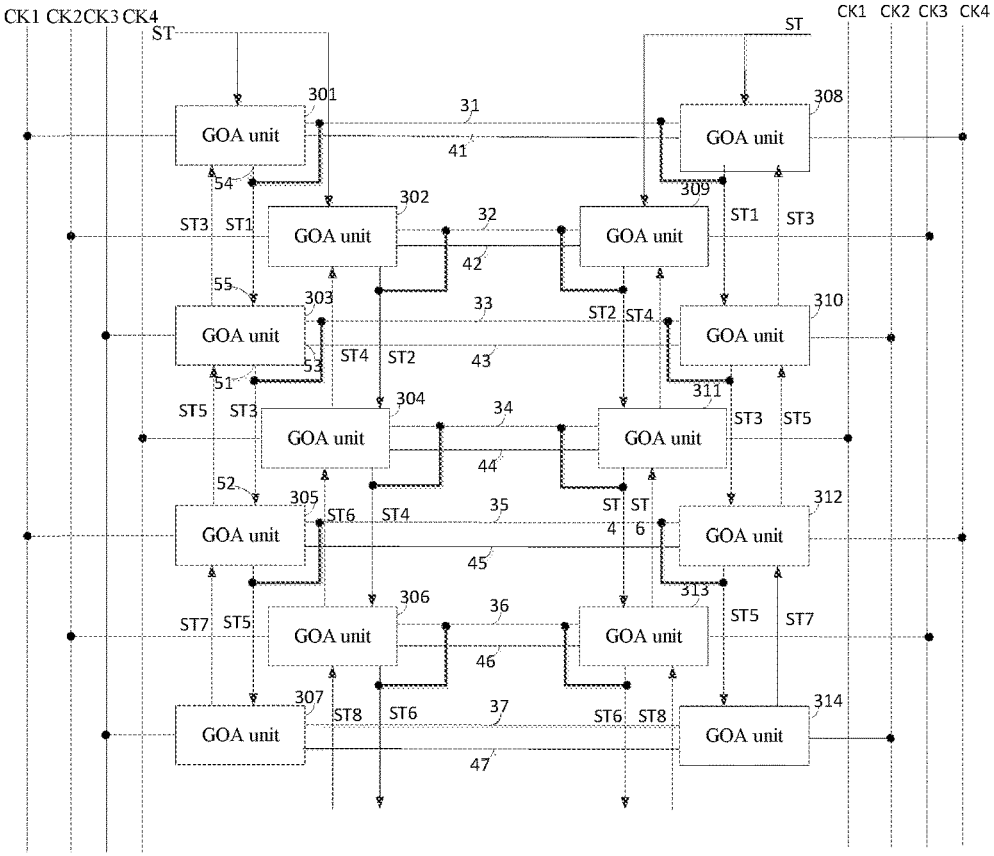
FIG. 5 illustrates a schematic diagram of a driving circuit according a fourth embodiment of the present disclosure.

Please refer to FIG. 5 illustrating a schematic diagram of a driving circuit according to a second embodiment of the present disclosure.

As FIG. 5 shows, a driving circuit proposed by this embodiment is a gate-driver on array (GOA) circuit. The driving circuit is used to input a scanning signal to a display panel. The display panel includes n rows of pixels. A scanning line set is correspondingly arranged on each of the n rows of pixels. The scanning line set includes a primary scanning line and a secondary scanning line.

Figure 5A:
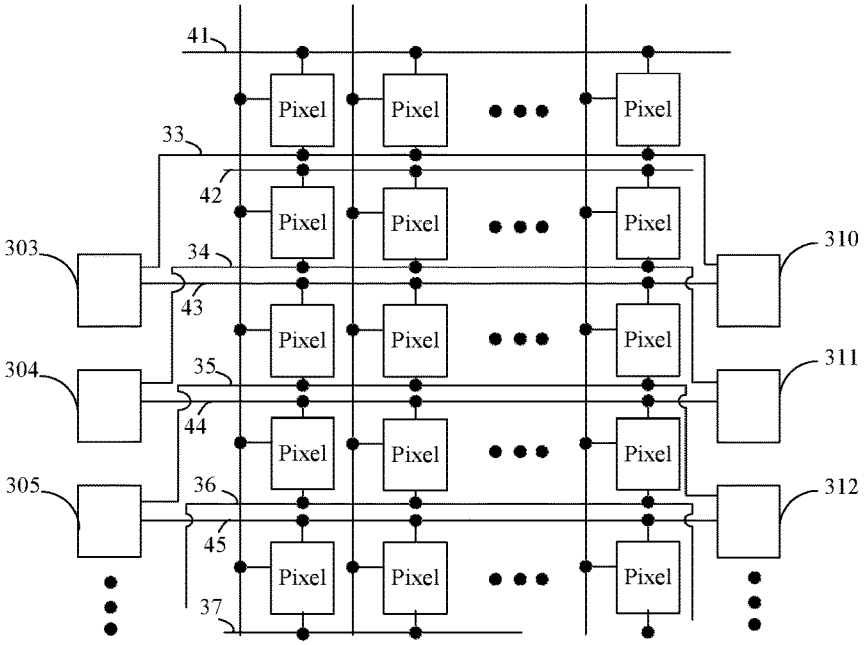
FIG. 5A illustrates connections among the GOA units, primary scanning lines, and secondary scanning lines of FIG. 5.

The driving circuit includes the GOA unit set at seven stages. The GOA unit set includes two GOA units arranged at the corresponding sides of the scanning line set. The first stage GOA unit to the seventh stage GOA unit at the left side is 301 to 307. The first stage GOA unit to the seventh stage GOA unit at the right side is 308 to 314. The GOA unit at every stage corresponds to a row of pixel. The nth stage GOA unit set corresponds to the nth row of primary scanning line and the (n−2)th row of secondary scanning line, as shown in FIG. 5A. "N" is greater than or equal to two, and "k" is greater than or equal to one. For example, the third stage GOA unit 303 corresponds to the primary scanning line 43 on the third row of pixel and the secondary scanning line 33 on the first row of pixel. The similar condition occurs to the remaining GOA units at other stages. It is understood that 31-37 indicates the secondary scanning lines and 41-47 indicates the primary scanning lines.

The nth stage GOA unit arranged at the left side of the scanning line set is cascaded with the (n+2)th stage GOA unit arranged at the left side of the scanning line set. The nth stage GOA unit arranged at the right side of the scanning line set is cascaded with the (n+2)th stage GOA unit arranged at the right side of the scanning line set. Take the left side of the scanning line set for example. The first stage GOA unit 301 is cascaded with the third stage GOA unit 303. The third stage GOA unit 303 is cascaded with the fifth stage GOA unit 305. The fifth stage GOA unit 305 is cascaded with the seventh stage GOA unit 307. The GOA unit at the right side is similar to the GOA unit at the left side.

The GOA unit at every stage at the left side is electrically connected to the GOA unit at every stage at the right side. For example, the first stage GOA unit 301 at the left side is electrically connected to the first stage GOA unit 308 at the right side. The similar condition occurs to the remaining GOA units at other stages.

In one embodiment, an output terminal of a third stage GOA unit at the left side 303 is connected to a secondary scanning line 33 of a first row of pixel (that is, a first row of secondary scanning line). An output terminal of a third stage GOA unit at the right side 310 is also connected to the secondary scanning line 33 of the first row of pixel. The output terminal may include an output terminal of a scanning signal and an output terminal of a cascade signal.

The GOA units at both sides correspondingly are electrically connected through the secondary scanning line so the signal output by the output terminal of the GOA unit at the left side can be transmitted to the output terminal of the GOA unit at the right side. In this way, once the GOA unit at some stage is abnormal, other GOA units following the current stage GOA unit can still work normally. For example, once the ST signal of a first GOA unit at the right side is output abnormally, a thin-film transistor (TFT) T22 of a first GOA unit at the right side is cut off. In other words, all signals output by the current stage GOA unit are completely supplied by the GOA unit at the left side. Thus, the third stage GOA unit, the fifth stage GOA unit, and the seventh stage GOA unit can work normally. It is understood that the connection method of the GOA units at the other stages is the same as the connection method of the third stage GOA unit.

Each of the GOA units includes an input terminal of a first cascade signal, an input terminal of a second cascade signal, an output terminal of a scanning signal, and an output terminal of the stage cascade signal. In one embodiment, an output terminal of a scanning signal of an nth stage GOA unit arranged at one side where the scanning line set is arranged is connected to an input terminal of a first cascade signal of an (n+2)th stage GOA unit arranged at one side where the scanning line set is arranged. An output terminal of the stage cascade signal of the nth stage GOA unit is connected to an (n−2)th row secondary scanning line.

For example, an output terminal 51 of the cascaded signal of the third stage GOA unit at the left 303 is cascaded with an input terminal 52 of the first cascaded signal of the fifth stage GOA unit at the left. The output terminal 51 of the cascaded signal of the third stage GOA unit at the left 303 is further connected to the first row of secondary scanning line 33. The output terminal 53 of the scanning signal of the third stage GOA unit at the left 303 is connected to the third row of the primary scanning line 43. The input terminal 55 of the first cascade signal of the third stage GOA unit 303 is connected to an output terminal 54 of the cascaded signal of the first stage GOA unit 301. The input terminal of the second cascade signal of the third stage GOA unit 303 is connected to an output terminal of the cascaded signal of the fifth stage GOA unit to pull down the signal output by the output terminal of the third stage GOA unit 303. The GOA unit at the right side is similar to the GOA unit at the left side.

In one embodiment, an output terminal of the scanning signal of the nth stage GOA unit is connected to the (n−2)th row of secondary scanning line. For example, an output terminal of the scanning signal of the third stage GOA unit at the left 303 is connected to the first row of secondary scanning line. Also, an output terminal of the scanning signal of the third stage GOA unit at the right 310 is connected to the first row of secondary scanning line.

The GOA unit includes an input terminal of a clock signal. The input terminal of the clock signal is used to input a clock signal. The driving circuit includes a first clock signal set and a second clock signal set. The first clock signal set and the second clock signal set are arranged opposite. Each of the first clock signal set and the second clock signal set includes a first clock signal CK1, a second clock signal CK2, a third clock signal CK3, and a fourth clock signal CK4.

The GOA circuit may include a GOA unit at more than seven stages.

The present disclosure is not limited to the cascade method for the GOA unit in this embodiment. Other cascade methods can be adopted in the present disclosure.

Figure 6:
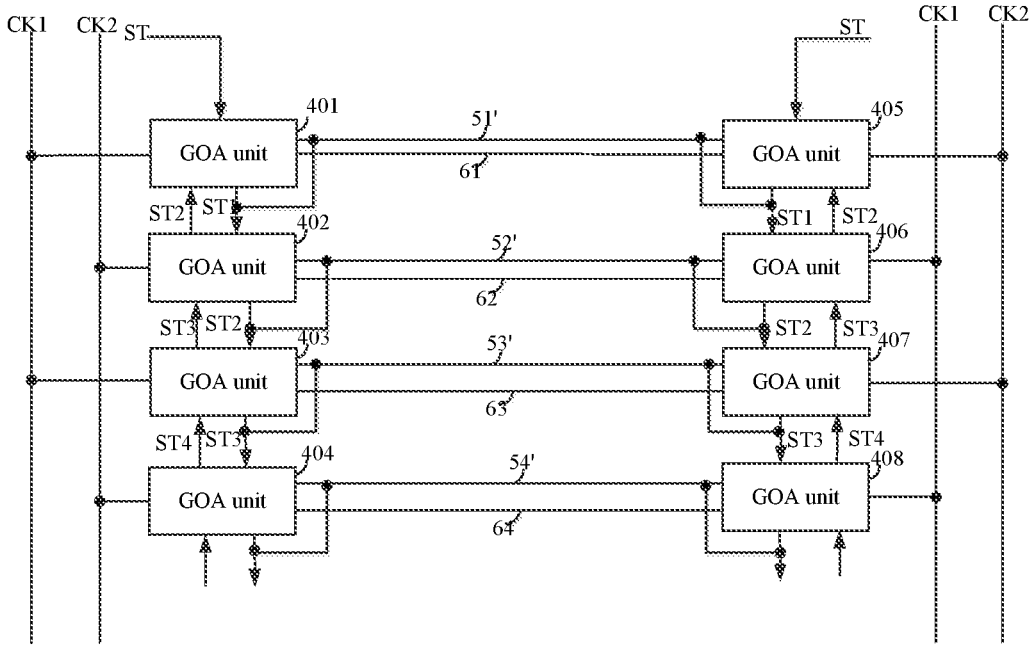
FIG. 6 illustrates a schematic diagram of a driving circuit according a fifth embodiment of the present disclosure.

As FIG. 6 shows, further, the first stage GOA unit may be at the side where the scanning line is arranged is cascaded with the second stage GOA unit at the same side. The driving circuit includes a GOA unit set at four stages. The GOA unit set includes two GOA units at both sides of the scanning line set which the GOA unit set corresponds to. The GOA unit at four stages at the left side is 401 to 404. The GOA unit at four stages at the right side is 405 to 408. The nth stage GOA unit set corresponds to an nth row of primary scanning line and an (n−1) row of secondary scanning line. "N" is greater than or equal to one, and "k" is greater than or equal to one. For example, the third stage GOA unit 403 corresponds to the primary scanning line 63 on the third row of pixel and the secondary scanning line 53' on the second row of pixel. The similar condition occurs to the remaining GOA units at other stages. It is understood that 51'-54' indicates the secondary scanning lines and 61-64 indicates the primary scanning lines.

In addition to the cascade method as shown in FIG. 5 and FIG. 6, the nth stage GOA unit in the GOA circuit may also be cascaded with the (n+k)th stage GOA unit. "K" is greater than two. At this time, the nth stage GOA unit set corresponds to the nth row of primary scanning line and the (n−k)th row of secondary scanning line. The nth stage GOA unit arranged at the side where the scanning line set is arranged is cascaded with the (n+k)th stage GOA unit at the same side. The nth stage GOA unit arranged at a first side where the scanning line set is arranged is electrically connected to the nth stage GOA unit arranged at a second side where the scanning line set is arranged.

In one embodiment, an output terminal of an nth stage GOA unit arranged on the first side of a scanning line set is connected to an (n−k)th row secondary scanning line. Also, an output terminal of an nth stage GOA unit arranged on the second side of the scanning line set is connected to the (n−k)th row of secondary scanning line.

In one embodiment, the GOA unit includes an input terminal of a first cascade signal, an input terminal of a second cascade signal, an output terminal of a scanning signal, and an output terminal of a cascade signal.

The output terminal of the cascade signal of the nth stage GOA unit arranged on the same side of the scanning line set is connected to the input terminal of the first cascade signal of the (n+k)th stage GOA unit. The output terminal of the cascade signal of the nth stage GOA unit is connected to the (n−k)th row of secondary scanning line.

In one embodiment, an output terminal of a scanning signal of an nth stage GOA unit is connected to an nth row primary scanning line. An input terminal of a first cascade signal of the nth stage GOA unit is connected to an output terminal of a cascade signal of an (n−k)th stage GOA unit. Also, an input terminal of a second cascade signal of the nth stage GOA unit is connected to the output terminal of the cascade signal of an (n+2)th stage GOA unit.

In one embodiment, an output terminal of a scanning signal of an nth stage GOA unit is connected to an (n−2)th row secondary scanning line.

The output terminal of the GOA unit at the same stage at the left side is connected to the GOA unit at the right side in the diver circuit proposed by the present disclosure. Once a STV signal of the GOA unit at either side is abnormal, a STV signal of the GOA unit at the other side (i.e. the normal side) is transmitted to the GOA unit at the abnormal side to prevent the following GOA units ineffective.

A display panel is further proposed by the present disclosure, and the display panel includes a driving circuit proposed in the above-mentioned embodiment.

Figure 7:
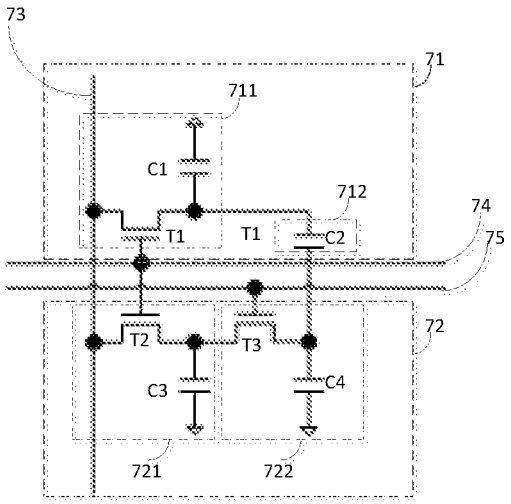
FIG. 7 illustrates a schematic diagram of a pixel according an embodiment of the present disclosure.

Please refer to FIG. 7 illustrating a schematic diagram of a pixel according to one embodiment of the present disclosure.

As FIG. 7 shows, the display panel includes a plurality of scanning lines sets, a plurality of data lines, and a plurality of pixels defined by the scanning line set and the data line.

The scanning line set includes a primary scanning line 74 and a secondary scanning line 75. The pixel includes a main pixel zone 71 and a subpixel zone 72. A first charging module 711 and a pull-up module 712 are arranged on the main pixel zone 71. The first charging module 711 is used to charge the main pixel zone 71 while charging the subpixel zone 72. The pull-up module 712 is used to pull up the voltage level of the main pixel zone 71 after the main pixel zone 71 and the subpixel zone 72 are fully charged.

In one embodiment, the first charging module 711 includes a first TFT T1. A gate of the first TFT T1 is connected to the primary scanning line 74. A source of the first TFT T1 is connected to the data line 73. The first charging module 711 further includes a first liquid crystal capacitor C1. One terminal of the first liquid crystal capacitor C1 is connected to a drain of the first TFT T1. The other terminal of the first liquid crystal capacitor C1 is grounded.

In one embodiment, a pull-up module 712 includes a first sharing capacitor C2. One terminal of the first sharing capacitor C2 is connected to the drain of the first TFT T1. The other terminal of the first sharing capacitor C2 is connected to a drain of the third TFT T3. In one embodiment, the pull-up module 712 may be other kind of power-storage component.

A second charging module 72 and a pull-down module 722 are arranged on the subpixel zone 72.

The second charging module 721 is used to charge the subpixel zone 72 while charging the main pixel zone 71. The pull-down module 722 is used to pull down the voltage level of the subpixel zone 72 after the main pixel zone 71 and the subpixel zone 72 are fully charged.

The second charging module 721 includes a second TFT T2. A gate of the second TFT T2 is connected to the primary scanning line 74. A source of the second TFT T2 is connected to the data line 73.

The second charging module 721 further includes a second liquid crystal capacitor C3. One terminal of the second liquid crystal capacitor C3 is connected to a drain of the second TFT T2. The other terminal of the second liquid crystal capacitor C3 is grounded.

The pull-down module 722 includes a third TFT T3 and a second branch capacitor C4. A gate of the third TFT T3 is connected to the secondary scanning line 75. A source of the third TFT T3 is connected to the drain of the second TFT T2. A drain of the third TFT T3 is connected to the other terminal of the first charging capacitor C2 and one terminal of the second branch capacitor C4. The other terminal of the second branch capacitor C4 is grounded.

The secondary scanning line 75 is at high voltage level to push the third TFT T3 to be turned on and further to charge the second sharing capacitor C4. Because the first sharing capacitor C2 is also connected to the drain of the third TFT T3, the voltage imposed on the first sharing capacitor C2 is the same as the voltage imposed on the second sharing capacitor C4. Besides, the voltage on the first liquid crystal capacitor C1 increases, and the brightness of the main pixel zone enhances accordingly.

In one embodiment, a primary scanning line at an nth row of pixel is connected to an output terminal of a scanning signal of an nth stage GOA unit. A secondary scanning line at the nth row of pixel is connected to an output terminal of the cascade signal of an (n+2)th stage GOA unit The pull-up module is arranged on the main pixel zone of the display panel so that the voltage level of the subpixel zone can be pulled down. Further, the voltage difference between the main pixel zone and the subpixel zone is enlarged to reduce color shift effectively.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

What is claimed is:

1. A driving circuit, configured to input a scanning signal to a display panel; the display panel comprising n rows of pixels; a scanning line set being correspondingly arranged on each of the n row of pixel; the scanning line set comprising a primary scanning line and a secondary scanning line;

the driving circuit comprising gate-driver on array (GOA) unit sets at n stages, a first clock signal set, and a second clock signal set; an nth stage GOA unit set corresponding to an nth row of primary scanning line and an (n−k)th row of secondary scanning line; the GOA unit set comprising two GOA units arranged at a first side and a second side of the scanning line set;

the nth stage GOA unit arranged at either side of the scanning line set being cascaded with the (n+k)th stage GOA unit at the same side;

an output terminal of the nth stage GOA unit arranged at the first side where the scanning line set is arranged being connected to an (n−k)th row of secondary scanning line; the output terminal of the nth stage GOA unit arranged at the second side where the scanning line set is arranged being also connected to the (n−k)th row of secondary scanning line, wherein "n" is greater than or equal to one, and "k" is greater than or equal to one, wherein each GOA unit comprises an input terminal of a first cascade signal, an output terminal of a cascade stage signal, and an output terminal of a scanning signal;

the output terminal of the cascade stage signal of the nth stage GOA unit arranged on the same side of the scanning line set is connected to the input terminal of the first cascade signal of the (n+k)th stage GOA unit and the (n−k)th row of secondary scanning line, wherein each GOA unit further comprises an input terminal of a second cascade signal;

the output terminal of the scanning signal of the nth stage GOA unit is connected to an nth row of primary scanning line;

the input terminal of the first cascade signal of the nth stage GOA unit is connected to an output terminal of the cascade signal of the (n−2)th stage GOA unit;

the input terminal of the second cascade signal of the nth stage GOA unit is connected to an output terminal of the cascade stage signal of the (n+2)th stage GOA unit.

2. The driving circuit of claim 1, wherein the output terminal of the scanning signal of the nth stage GOA unit is connected to an (n−2)th row of secondary scanning line.

3. The driving circuit of claim 1, wherein the GOA unit comprises an input terminal of a clock signal; the input terminal of the clock signal is configured to input a clock signal.

* * * * *